US007344393B2

(12) United States Patent
Buller et al.

(10) Patent No.: US 7,344,393 B2
(45) Date of Patent: Mar. 18, 2008

(54) ELECTRIC PLUG COMPRISING A PLUG HOUSING AND AT LEAST TWO INTEGRATED PLUG-IN CONTACTS WITH AN EJECTION MECHANISM

(75) Inventors: Kai Buller, Glandorf (DE); Andreas Schmedt, Harsewinkel (DE); Dirk Wegener, Bielefeld (DE)

(73) Assignee: Miele & Cie. KG, Guetersloh (DE)

( * ) Notice: Subject to any disclaimer, the term of this patent is extended or adjusted under 35 U.S.C. 154(b) by 0 days.

(21) Appl. No.: 10/598,291

(22) PCT Filed: Feb. 17, 2005

(86) PCT No.: PCT/EP2005/001613

§ 371 (c)(1),
(2), (4) Date: Aug. 23, 2006

(87) PCT Pub. No.: WO2005/081367

PCT Pub. Date: Sep. 1, 2005

(65) Prior Publication Data

US 2007/0155191 A1 Jul. 5, 2007

(30) Foreign Application Priority Data

Feb. 24, 2004 (DE) ..... 10 2004 009 403

(51) Int. Cl.
*H01R 13/62* (2006.01)

(52) U.S. Cl. ..... 439/152; 439/159; 439/180

(58) Field of Classification Search ..... 439/152–160, 439/180

See application file for complete search history.

(56) References Cited

U.S. PATENT DOCUMENTS

| | | | | |
|---|---|---|---|---|
| 2,566,040 | A * | 8/1951 | Simmons | 239/8 |
| 2,986,719 | A * | 5/1961 | Adams | 439/152 |
| 3,737,835 | A | 6/1973 | Clement et al. | |
| 5,480,313 | A | 1/1996 | d'Alayer de Costemore d'Arc et al. | |
| 5,800,189 | A * | 9/1998 | Ahmed | 439/159 |
| 6,364,675 | B1 * | 4/2002 | Brauer et al. | 439/159 |
| 6,540,533 | B1 * | 4/2003 | Schreiber | 439/159 |
| 6,716,044 | B2 * | 4/2004 | Bertke | 439/160 |
| 2002/0064983 | A1 * | 5/2002 | Patey | 439/152 |

FOREIGN PATENT DOCUMENTS

| | | |
|---|---|---|
| DE | 4105985 | 9/1992 |
| DE | 29807627 | 9/1998 |
| EP | 0501237 | 9/1992 |

* cited by examiner

*Primary Examiner*—Briggitte R. Hammond
*Assistant Examiner*—Larisa Tsukerman
(74) *Attorney, Agent, or Firm*—Darby & Darby

(57) ABSTRACT

An electric plug includes a plug housing, at least two incorporated plug-in contacts that are to be inserted into corresponding jacks of an outlet, and a cable feeder. A manually actuated ejection mechanism encompassing a push-out device is disposed in the plug housing. The push-out device cooperates with a spring in such a way that the spring is biased in the plugged-in state of the plug in order to allow the plug to be automatically removed from the outlet by means of the push-out device when the ejection mechanism is actuated. In order to actuate the ejection mechanism, the same is automatically triggered by pulling on the cable, the tensile force being effective on a strain relief device for the cable, which is located in the plug housing and cooperates with triggering device for actuating the spring-biased push-out device.

7 Claims, 1 Drawing Sheet

ELECTRIC PLUG COMPRISING A PLUG HOUSING AND AT LEAST TWO INTEGRATED PLUG-IN CONTACTS WITH AN EJECTION MECHANISM

CROSS REFERENCE TO PRIOR APPLICATIONS

This application is a U.S. National Phase of International Patent Application No. PCT/EP2005/001613, filed Feb. 17, 2005, which claims priority to German Patent Application No. DE 10 2004 009 403.9, filed Feb. 24, 2004, the entire disclosure of which is incorporated by reference herein. The International Application was published in German on Sep. 1, 2005 as WO 2005/081367 A1.

FIELD OF THE INVENTION

The present invention relates to an electric plug including a plug housing and at least two integrated plug-in contacts to be inserted into corresponding female receptacles of an outlet, and a cable entry, a manually actuated ejection mechanism having push-out means being disposed in the plug housing, and the push-out means cooperating with a spring in such a way that the spring is biased when the plug is in the plugged-in state, so that the plug is automatically removed from the outlet by means of the push-out means when the ejection mechanism is actuated. The actuation for the automatic triggering of the ejection mechanism is accomplished by pulling on the cable, the pulling force acting on a strain relief device which is provided for the cable in the plug housing and which, in turn, cooperates with triggering means for actuating the push-out means which is biased by the spring.

BACKGROUND

In the prior art, U.S. Pat. No. 3,737,835 discloses such an electric plug, which is provided with a manually actuated, self-triggering ejection mechanism. In this known ejection mechanism, actuation is via a rotatably mounted element which is circumferentially held on the plug housing in the region of the tube or cable entry and which retains by springs in the housing in a push-out means biased by a spring. When the rotatable element is operated by hand, the biased push-out means is released and ejects the plug from the outlet. When placing the plug back into the outlet, the spring of the push-out means is tensioned again, whereupon the spring-biased rotatable means locks the biased push-out means in position again.

U.S. Pat. No. 5,480,313 discloses an embodiment of a plug ejection mechanism, which is similar, but different in design. It is a particular feature of this embodiment that the housing of the plug is formed by a rotatable sleeve which has spiral grooves on the inside to provide a connecting link guide for the ejection means, which are in the form of sliders disposed laterally in the plug-in member. The sleeve rotatably mounted on the plug cooperates with a radially acting spiral spring which is located in the plug and released via the strain relief device of the cable when a pulling force acts on the cable. Thus, the strain relief device itself constitutes the triggering means which releases the biased, rotatably mounted sleeve, so that the ejection means (here the sliders) are moved toward the outlet along a restricted path in the sleeve, thus causing the plug to be released.

SUMMARY OF THE INVENTION

It is considered a disadvantage of the first-mentioned ejection mechanism that it can only be actuated directly at the plug. In the second-mentioned design approach, it is considered a disadvantage that biasing of the ejection mechanism is via the housing itself, and that the plug cannot be ejected in a quick and abrupt manner due to the frictional losses occurring during the movement of the ejection means in the connecting link guide.

An object of the present invention is to improve an electric plug having a self-triggering ejection mechanism in such a way that the self-triggering ejection mechanism does not have to be actuated directly at the plug housing, the intention being to improve the ejection effect of the ejection means.

In the ejection mechanism according to the present invention, the triggering means and the ejection means are arranged in the housing in such a way that ejection means located in the axis of rotation is triggered directly. The released spring force then acts directly against the bottom of the outlet, which leads to improved ejection of the plug from the outlet. In addition, the solution according to the present invention does not require actuating means for controlling the biasing the ejection means. In the solution according to the present invention, the ejection means are biased only by the insertion process.

Another particular advantage that can be achieved with the present invention is that the ejection mechanism can be actuated from a position remote from the plug, using the cable. The advantage of this is that when using longer cables, as in the case of vacuum cleaners, ejection of the plug may be accomplished via the vacuum cleaner cable when the cable is in an extended condition. To this end, the actuation for the automatic triggering of the ejection mechanism is accomplished by pulling on the cable itself, the applied pulling force then acting on a strain relief device which is provided for the cable in the plug housing and which, in turn, cooperates with triggering means for actuating the push-out means which is biased by the spring. Thus, in particular, the pulling force is transmitted to the strain relief device via the cable sheath, without causing damage to the cable itself.

The automatic ejection mechanism reduces stress on the outlet and the strain relief device of the cable in the event of improper use, which occurs frequently in everyday life, such as removing the plug from the outlet by pulling on the cable, exceeding the maximum possible radius of action by pulling on the appliance.

The stress exerted on the outlet and the cable when tripping over the cable is also reduced by ejection of the plug. Ejection is possible not only by pulling lengthwise on the cable, but can also be accomplished by pulling in a transverse direction, as occurs frequently with outlets located in the area of a door.

Advantageously, the triggering means includes an element which is rockingly supported in the plug housing and which, in a first position, retains the triggering means against the action of a spring and, in a second position, releases the push-out means in response to a pulling force acting on the strain relief device. In this manner, it is ensured that the triggering means always returns to its first position as a result of the spring tension, and that it can be moved to a second, releasing position only by the applied pulling force. The rocker-like element is substantially composed of two hinge pins which are located in one axis of rotation and are connected by a bridge element extending below the push-out means. On the side facing the push-out means, the bridge element itself includes a latchbolt-like surface, the strain relief device for the cable being formed thereon below. In this manner, a triggering means is provided which, as it were, pivotally extends around the push-out means in the narrow space of the plug housing, the hinge pins being inserted in the side walls of the plug housing.

The push-out means is composed of a plunger which is movable between the plug contacts and supported in the bottom region and in the cable entry region of the plug housing. In approximately the middle of the plunger, there is disposed a retaining element against which bears the biased spring on the one hand, and which, on the other hand, provides the latching connection with the latchbolt-like surface of the bridge element. It is obvious that when the triggering means, i.e., the latchbolt-like surface, is pivoted, the biased spring pushes the retaining element toward the bottom surface of the plug, causing the plunger to move out of the housing, and thus, to push the plug out of the outlet socket.

In an advantageous refinement, a plate-like element is formed on the end of the plunger, said plate-like element pressing flat against a contact surface in the outlet during the ejection process. Thus, the force is applied to the surface of the outlet in a uniformly distributed manner, avoiding damaging point loads.

In the non-actuated state, the plate-like element is located in an opening in the bottom surface of the plug housing. In particular, in order to provide an exact sliding path for the plunger, the plate-like element is provided with recesses which encircle the plug-in contacts partially and/or in some regions thereof. Because of this, the plate-like element is stably guided between the plug-in contacts. In the case that the ejection mechanism is locked against unintentional actuation, a locking means is provided in the region of the cable entry, said locking means locking the plunger in its retracted position.

BRIEF DESCRIPTION OF THE DRAWINGS

An exemplary embodiment of the present invention is shown in the drawings in a purely schematic way and will be described in more detail below. In the drawing.

DETAILED DESCRIPTION

Figure 1:
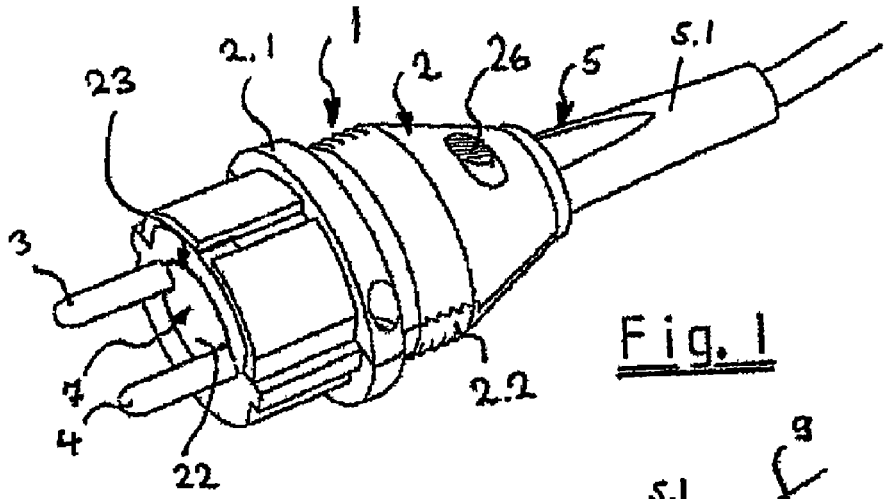
FIG. 1 is a perspective view of an electric plug.

FIG. 1 shows, in a perspective view, an electric plug 1 having a plug housing 2 and at least two integrated plug-in contacts 3 and 4 to be inserted into corresponding female receptacles (not shown) of an outlet. Plug housing 2 is substantially composed of two housing shells 2.1 and 2.2 enclosing the cable entry 5 on the one hand, and also an ejection mechanism 6 including push-out means 7. A push-out means 7 cooperates with a spring 8 (shown more clearly in FIGS. 2 and 3) in such a way that spring 8 is biased when plug 1 is in the plugged-in state. When actuating ejection mechanism 6, plug 1 is automatically removed from the outlet (not specifically shown) by means of push-out means 7. To this end, spring 8 is released, so that push-out means 7 moves out in the direction of the arrow shown.

In accordance with the present invention, the actuation for the automatic triggering of ejection mechanism 6 is accomplished by pulling on cable 9, the pulling force (also indicated by the direction of an arrow) acting on a strain relief device 10 which is provided for cable 9 in plug housing 2 and which, in turn, cooperates with triggering means 11 for actuating push-out means 7 which is biased by spring 8. Strain relief device 10 is provided by clamping the cable sheath firmly in place, so that, in particular, the pulling force acts mainly in the cable sheath.

Figure 2:
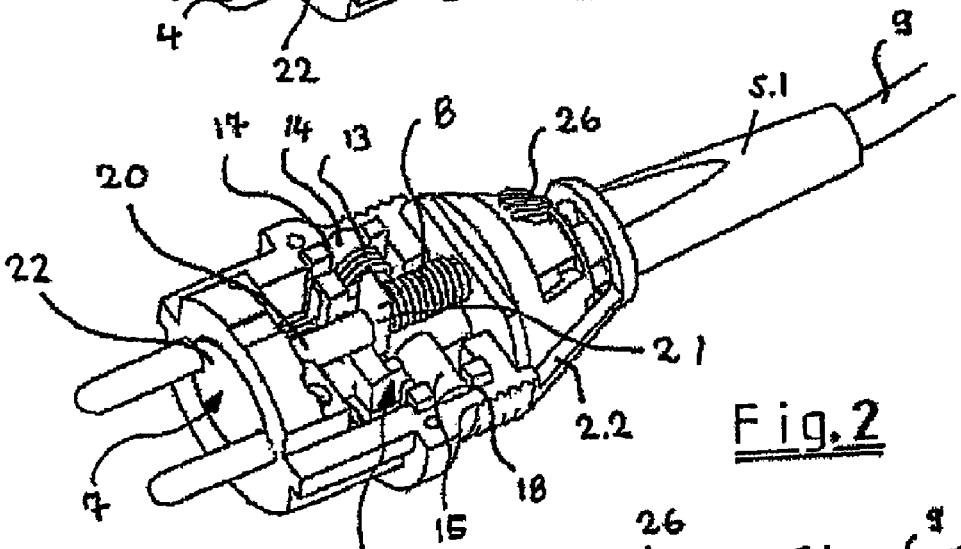
FIG. 2 is another perspective view, showing the plug of FIG. 1 with the housing open.

When viewing FIGS. 1 and 2 together, it can be seen that triggering means 11 includes an element 12 which is rockingly supported in plug housing 2 and whose movement is also indicated by the directions of arrows. In a first position, element 12 retains triggering means 7 against the action of a spring 13 and, in a second position, it releases push-out means 7 in response to the pulling force acting on strain relief device 10. As can be seen, rocker-like element 12 is substantially composed of two hinge pins 14 and 15 which are located in one hinge axis and are connected by a bridge element 16 extending below push-out means 7. Spring 13, which takes the form of a spiral spring, is slipped onto hinge pin 14, one turn of the spring being connected to bridge element 16, so that spring 13 always urges bridge element 16 into the retaining position.

As is clear from FIG. 2, hinge pins 14 and 15, which are located in one axis of rotation, are pivotally supported in recesses 17 and 18 of housing parts 2.1 and 2.2. From FIG. 3, it can be seen that, on the side facing push-out means 7, bridge element 16 has a latchbolt-like surface 19 which slopes slightly upward, the strain relief device 10 for the cable (not specifically shown) being formed thereon below.

The push-out means 7 itself is provided in plug housing 2 in such a way that it is supported as a movable plunger 20 between plug-in contacts 3 and 4, suitable supporting points being provided in the bottom region and in the cable entry region of plug housing 2, respectively. In approximately the middle of plunger 20, there is disposed a retaining element 21 against which bears biased spring 8 on the one hand, and which, on the other hand, provides the latching connection with latchbolt-like surface 19 of bridge element 16. Now it becomes clear that when bridge element 16 is pivoted, retaining element 21 is released via latchbolt surface 19, so that biased spring 8 is released and pushes plunger 20 out via retaining element 21. When plunger 20 is in the extended position and plug 1 is inserted into an outlet, plunger 20 is pushed back into housing 2 against the force of spring 8, thereby pushing retaining element 21 across latchbolt-like surface 19, whereupon bridge element 16 is pivoted back to its first position as a result of the action of spring 13, such that plunger 20 is in a biased position again.

Figure 3:
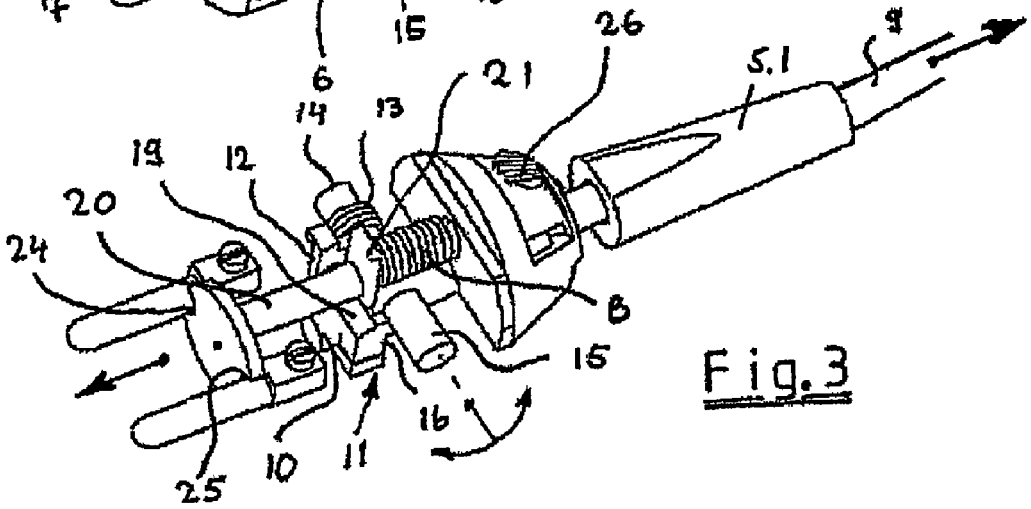
FIG. 3 is another perspective view according to FIGS. 1 and 2, without housing parts.

When viewing FIGS. 1 through 3 together, it can be seen that a plate-like element 22 is formed on the end of plunger 20, said plate-like element pressing flat against the contact surface in the outlet. When ejection mechanism 6 is not actuated, plate-like element 22 is located in an opening in bottom surface 23 of plug housing 2. Plate-like element 22 is provided with recesses 24 and 25 which encircle plug-in contacts 3 and 4 partially and/or in some regions thereof.

The ejection mechanism according to the present invention works not only when pulling lengthwise on cable 9, but also when pulling in a direction transverse to the plug. This situation occurs frequently when the outlet is located in the area of a door and the cable wraps around the door frame. In this case, the force exerted by pulling on cable 9 is introduced via anti-kink sleeve 5.1 which, in turn, causes a displacement of the cable end secured in the strain relief device. This small displacement is sufficient to activate the triggering means.

In an advantageous refinement of ejection mechanism 6, a locking means 26 is provided in the region of cable entry 5, said locking means, in particular, locking the retracted plunger 20 in a fixed position, thereby preventing, in particular, unintentional triggering of ejection mechanism 6. It is obvious that the released position and the locked position can be obtained by moving the locking means 26.

What is claimed is:

1. An electric plug for an outlet comprising:

a plug housing;

at least two integrated plug-in contacts configured to be inserted into corresponding female receptacles of the outlet;

a cable entry portion configured to receive a cable;

a manually actuated ejection mechanism having a push-out device disposed in the plug housing as a moveable plunger and configured to automatically remove the plug from the outlet;

a spring cooperating with the push-out device so that the spring is biased when the plug is in a plugged-in state;

a triggering device disposed in the housing and configured to actuate the ejection mechanism;

a strain relief device disposed in the plug housing and cooperating with the triggering device so that a pulling force from a pulling of the cable acts on the strain relief device to trigger the triggering device, wherein the triggering device, the push-out device and the spring are disposed so as to be urged into a biased position only by an insertion of the plug into the outlet;

a rocking element rockingly supported in the plug housing and moveable between a first position, in which the rocking element retains the triggering device against the spring, and a second position, in which the rocking element releases the push-out device in response to the pulling force against the strain relief device, wherein the rocking device includes two hinge pins located in an axis of rotation and a bridge element extending below the push-out device and connecting the two hinge pins, the bridge element having a latchbolt-like surface on a side facing the push-out device, the strain relief device being formed on the latchbolt-shaped surface below the latchbolt-like surface; and a retaining element disposed so as to act on the plunger, and to be acted upon by the biased spring and providing a latching connection with the latchbolt-shaped surface of the bridge element.

2. The electric plug as recited in claim 1, wherein the housing includes at least two housing shells.

3. The plug as recited in claim 1, wherein the plunger is moveably disposed between the at least two plug-in contacts and supported in a bottom region and in the cable entry region of the plug housing.

4. The plug as recited in claim 3, wherein the plunger includes a plate-shaped element formed at one end of the plunger, the plate-shaped element pressing flat against a contact surface of the outlet during an ejection process of the plug and having guide elements configured to guide the plate-shaped element between the at least two plug-in contacts during the ejection process.

5. The plug as recited in claim 4, wherein the plate-like element includes recesses that at least partially encircle the plug-in contacts.

6. The plug as recited in claim 5, wherein in a non-actuated state, the plate-shaped element is located in an opening in a bottom surface of the plug housing.

7. The plug as recited in claim 1, further comprising a locking device disposed in a region of the cable entry, said locking device preventing an unintentional triggering of the ejection mechanism.

* * * * *